US006085445A

United States Patent [19]

Kanzler

[11] Patent Number: 6,085,445

[45] Date of Patent: Jul. 11, 2000

[54] PISTE-PREPARATION DEVICE

[76] Inventor: Helmut Kanzler, Obere Haupstrasse 39, 89269 Voehringen, Germany

[21] Appl. No.: 09/125,881

[22] PCT Filed: Feb. 26, 1997

[86] PCT No.: PCT/EP97/00932

§ 371 Date: Mar. 29, 1999

§ 102(e) Date: Mar. 29, 1999

[87] PCT Pub. No.: WO97/32085

PCT Pub. Date: Sep. 4, 1997

[30] Foreign Application Priority Data

Feb. 26, 1996 [DE] Germany ..... 296 03 461 U

[51] Int. Cl.[7] ..... E01H 4/00

[52] U.S. Cl. ..... 37/222; 37/242; 37/305; 37/364; 37/462

[58] Field of Search ..... 37/360, 364, 410, 37/462, 219, 221, 222, 223, 404, 405, 237, 305, 356, 242, 249

[56] References Cited

U.S. PATENT DOCUMENTS 2,223,608 12/1940 George .
3,652,106 3/1972 Waterman .
4,432,672 2/1984 Bruderle et al. .
5,067,264 11/1991 Beeley .
5,940,995 8/1999 Venhomaa .

FOREIGN PATENT DOCUMENTS 0 151 757 8/1985 European Pat. Off. .
WO 99/18292 10/1998 WIPO .

OTHER PUBLICATIONS

Internationale Seilbahn Rundschau Revue Internationale Des Telepheriques, No. 5, Sep. 1993, WIEN AT, pp. 42–44, XP002031450, "Pisten–Bully–Top–Treff 1993" see p. 43, col. 4, line 26—p. 44, col. 3, line 12; figures.

*Primary Examiner*—H. Shackelford
*Attorney, Agent, or Firm*—Samuels, Gauthier & Stevens

[57] ABSTRACT

A piste-preparation device for preparing a half-pipe comprises at least one tool adjustably mounted on a piste vehicle, and lateral members which are laterally disposed relative to the tool and can essentially be assigned to side walls of the half-pipe. To prepare a half-pipe even in cases where the surface is hard and, at the same time, to remove a large amount of material, in particular from the half-pipe side walls, each lateral member comprises removal means designed with removal tools which can move substantially transversely to the direction of travel of the piste vehicle.

24 Claims, 3 Drawing Sheets

PISTE-PREPARATION DEVICE

Figure 1:
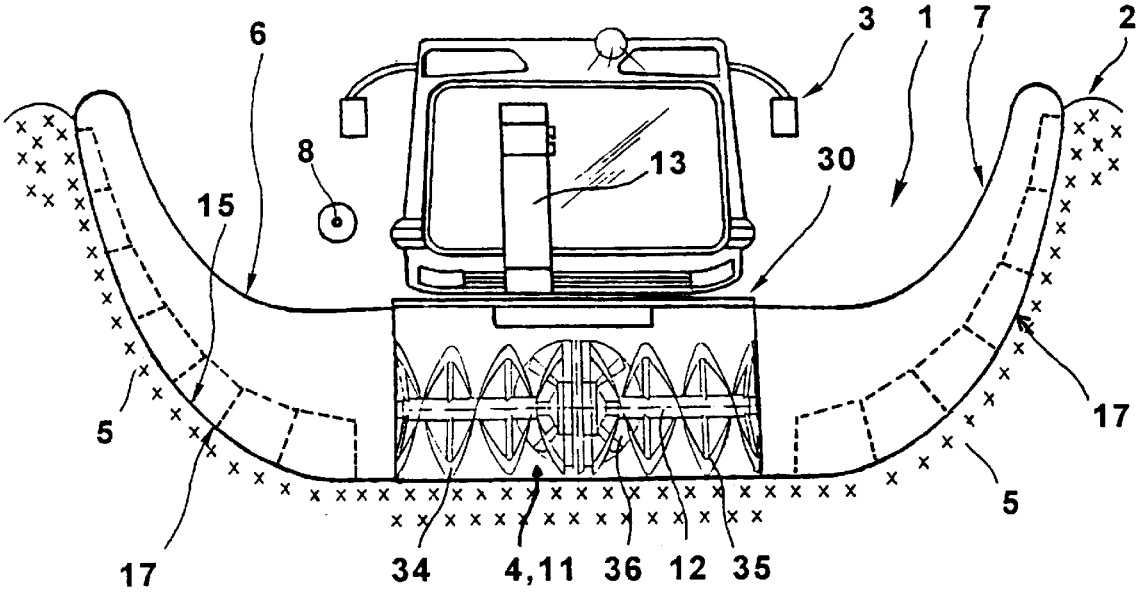

The present invention relates to a piste-preparation device for preparing a half-pipe, the device comprising at least one tool which is adjustably mounted on a piste vehicle, and lateral members which are disposed laterally relative to the tool and can essentially be assigned to half-pipe side walls.

Channel- or trough-like pistes for snowboards are called half-pipes. For preparing such a half-pipe, a prior-art piste-preparation device comprises side blades laterally arranged on a tool. These side blades are shaped such that the side walls of the half-pipe can be constructed and prepared with a competition profile.

In the prior-art piste-preparation device of the above-mentioned type, as is for instance known from the journal "Internationale Seilbahn-Rundschau" May/1993, pages 42–44, however, it has been found to be a disadvantage that only a small amount of material can be displaced by the side blades and that such a displacement is mainly possible in the direction of travel alone. Furthermore, it is difficult or even impossible to prepare hard surfaces.

It is therefore the object of the present invention to improve a piste-preparation device of the above-mentioned type in such a manner that a half-pipe can also be prepared when the surface is hard and, at the same time, that an increased amount of material can be removed, in particular from the half-pipe side walls.

This object is achieved in the above-mentioned piste-preparation device in that each lateral member comprises a removal means designed with removal tools that are movable substantially in a direction transverse to the direction of travel of the piste vehicle for preparing a piste surface of the half-pipe. Large amounts of materials can be removed from the side walls of the half-pipe by the removal tools which are movable in a direction transverse to the direction of travel. Moreover, material can also be removed when the piste vehicle is at a standstill, for instance, to work the half-pipe at one place more intensively. The removal tools are designed such that they can also work on a hard piste surface.

EP 0 151 757 A2 discloses a snow blower having supply plows laterally disposed relative to said blower. These supply plows serve to enlarge the entry cross-section of the snow blower. A typical application of the snow blowers is their use in airfields where high removing and conveying speeds are of special importance. Each of the supply plows comprises a belt conveyor element whose plane is in parallel with the plow-share plane of a plow-share forming the supply plows. The belt conveyor element comprises a plurality of rib-like projections which are movable towards the blower wheel of the snow blower. The accumulation of snow in front of the shares is to be prevented by the belt conveyor elements in a simple and inexpensive manner.

EP 0 151 757 A2 is silent about the use of the snow blower in connection with half-pipes and also about a treatment of a piste surface, whereas according to the invention a piste surface of a half-pipe can also be prepared directly by removal tools of a removal means, apart from the displacement of material in a direction transverse to the direction of travel.

Advantageously, the tool which is adjustably mounted on the piste vehicle is a rotary snow plow having at least one shaft. The half-pipe channel can be excavated by such a rotary snow plow. The shaft of the rotary snow plow may, for instance, be provided with two opposite spiral-shaped snow plow means by which snow can be displaced towards the center of the piste-preparation device. To remove snow which has accumulated there in an easy manner, the piste-preparation device further comprises a blower means which is assigned to the rotary snow plow for displacing snow supplied by the rotary snow plow. A blower means of such a type which is known per se comprises a blower wheel assigned to the spiral-shaped snow plow means, by which the snow supplied by the spiral-shaped snow plow means is fed to an ejection chimney and is discharged through said chimney. Snow can be removed from the half-pipe or supplied to the half-pipe at another place for repair work or the like by correspondingly orienting the ejection chimney. Corresponding drives and gears for the spiral-shaped snow plow means or the blower wheel can be controlled with respect to their speeds, so that these parts can be controlled with respect to their power, depending on the respective amount of snow. Moreover, the ejection width above the ejection chimney can be determined by the speed for the blower wheel.

It is advantageous, in particular when a half-pipe is constructed or in the case of a large amount of new-fallen snow, when the removal tools move away from the piste-preparation device towards a half-pipe edge and remove entrained material over said edge from the half-pipe. In cases where such a material removal by the removal tools over the edge is not possible or can only be carried out under great difficulties, a movement of the removal tools for removing snow from the half-pipe side walls essentially towards the rotary snow plow is of advantage. Snow is thereby displaced towards the rotary snow plow and from said snow plow to the blower means. The blower means can remove the snow from the half-pipe.

Various means can be used as a removal means as long as these means have corresponding removal tools which are movable along the half-pipe side walls for preparing said side walls. In the case of a simple removal means, said means comprises at least one endless chain which a number of removal tools project from towards the piste surface and the half-pipe side wall, respectively. Such an endless chain can be used in a simple manner for continuously treating the half-pipe.

For an easy support of the endless chain, a plurality of wheels and/or rolls are rotatably supported on the lateral member for guiding the endless chain. The endless chain is placed around said wheels or rolls and can be moved continuously. The wheels or rolls can be replaced at least in part by slide elements which support the endless chain.

To guide the endless chain in an easy manner at least in the area of the side walls of the half-pipe along a corresponding contour, the endless chain is guided by a plurality of contour wheels/rolls and/or contour slide elements as contour elements along a convexly curved removal section at a piste side of the lateral member which faces the piste surface.

Since the removal section extends at least along the side walls of the half-pipe, the endless chain can be deflected at the ends of the removal section. To this end corresponding deflection rolls or wheels are arranged at said ends.

In a very simple case a first deflection roll is arranged next to an end of the snow plow shaft at the valley side relative to the side wall of the half-pipe and a second deflection roll is arranged at the snow plow shaft or the end of the lateral member that is opposite to the rotary snow plow. It is thereby ensured that the removal device transports the entrained material up to a place directly adjacent to the rotary snow plow.

It is of advantage for driving the endless chain when at least one of the contour rolls, deflection rolls or a separate roll is designed as a drive roll.

In a simple embodiment of a drive roll, the drive roll may be designed as a toothed roll or as a drive sprocket.

To guide the endless chain in a simple manner, the drive roll may be arranged above the first deflection roll, with the endless chain between said rolls passing through a substantially vertical lifting section and subsequently through a return section between drive roll and second deflection roll. In the lifting section, material which has been entrained by the removal tools can be supplied to the rotary snow plow.

In a very simple case the rotational axes of all rolls extend substantially in parallel with the direction of travel of the piste vehicle or with the direction of movement of the piste-preparation device. For instance, the rotational axes of deflection rolls and contour rolls or wheels may just as well extend upwards slightly inclined in the direction of travel. As a result, a gap which narrows in a direction opposite to the direction of travel and through which, for instance, snow positioned in front of the piste-preparation device is supplied in an easier manner to the removal device can be formed between endless chain and first surface.

For simplifying the construction and for reducing the costs the endless chain can be guided along the return section without any support. Depending on the tension of the endless chain as exerted by the remaining rolls or wheels, the endless chain has a more or less great slack in the return section.

To construct and prepare half-pipes with different cross-sections, each of the lateral members is adjustably supported relative to the rotary snow plow at the working angle. Each lateral member can be adjusted separately. As a result, the side walls of the half-pipe may have different slopes.

In a simple embodiment such a configuration is implemented in that the lateral member is detachably secured to a frame of the rotary snow plow for supporting the shaft of the rotary snow plow and can be adjusted by an adjusting cylinder between the snow plow frame and lateral member at the working angle. Thanks to the detachable attachment, a side blade can for instance be arranged instead of a lateral member with removal device, either at one side or also at both sides relative to the rotary snow plow.

Depending on the configuration of the rotary snow plow, it may be an advantage when the lateral members are not directly secured to the frame of the rotary snow plow. An intermediate frame may here be arranged between the frame of the rotary snow plow and the lateral member for supporting and adjusting the lateral member relative to the frame of the rotary snow plow and relative to the rotary snow plow, respectively. Such an intermediate frame may just as well be arranged between lateral member and piste vehicle, whereby the lateral members are supported and are adjustable independently of the rotary snow plow.

To reliably transport material entrained by the removal device through the rotary snow plow, it is advantageous when at least the endless chain is arranged in the direction of travel in front of the rotary snow plow.

The removal tools may have the most different shapes. In a simple case the removal tools are transverse webs integrated into the endless chain. Similar to chain webs formed on the chains of the piste vehicle, the removal tools may just as well be formed by corresponding chain webs provided on the endless chain. The webs may extend over the entire width of the endless chain. In a further embodiment the removal tools are scraping elements detachably secured to the endless chain. A plurality of said scraping elements may, for instance, be arranged side by side and/or in offset fashion in the width direction of the chain.

Furthermore, it may here be of advantage when the working depth of the removal tools decreases in the direction of travel. The piste surface in the area of the half-pipe side walls is thereby first treated by removal tools having a small working depth and then by removal tools having a larger working depth. In the case of transverse webs the working depth can increase continuously in a direction opposite to the direction of travel.

For easily leveling again a piste surface of the side parts of the half-pipe, the piste surface having possibly been roughened by the removal tools, the lateral member for smoothing the piste surface may comprise a smoothing blade arranged downstream of the endless chain in the direction of travel. The smoothing blade may directly follow the endless chain with its removal tools, with removal means and smoothing blade being possibly arranged on a frame.

To simplify cornering movements of the piste vehicle in the half-pipe and/or to adapt the piste-preparation device to half-pipe sections having different widths, the lateral members may be supported to be extensible in a direction transverse to the direction of travel. A complete lateral adjustment of the tool with the lateral members can just as well be achieved through a joint lateral adjustment.

To control, for instance, the removal means separately at the two lateral members in response to the amount of work, each drive roll may have assigned thereto a separate, in particular electrical drive.

To cover the lateral members and the rotary snow plow, corresponding coverings or housings may be provided for. In giving the covering or housing a corresponding shape, snow that has accumulated in front of said housing may, for instance, be supplied to the rotary snow plow.

Figure 2:
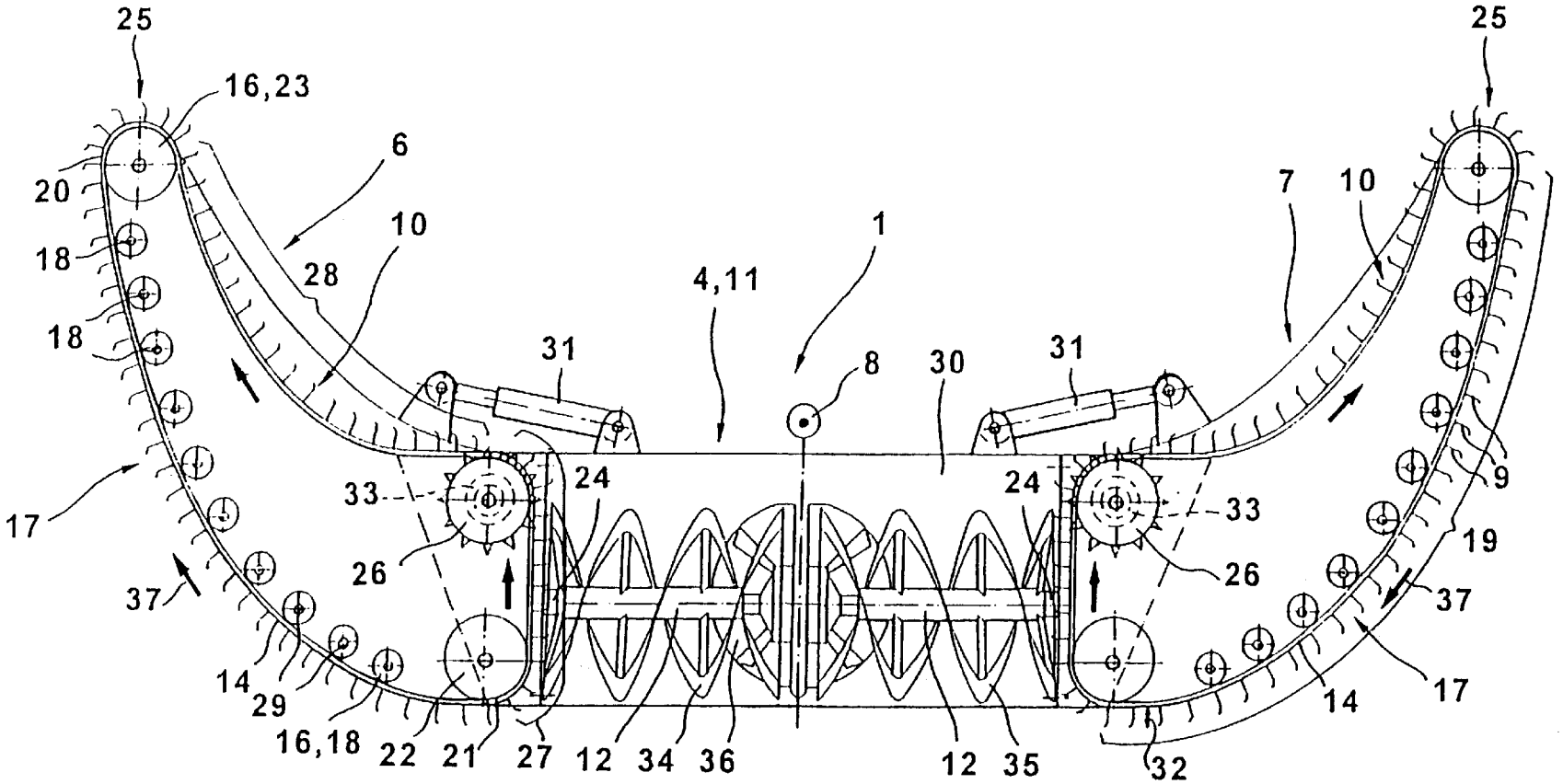
Figure 3:
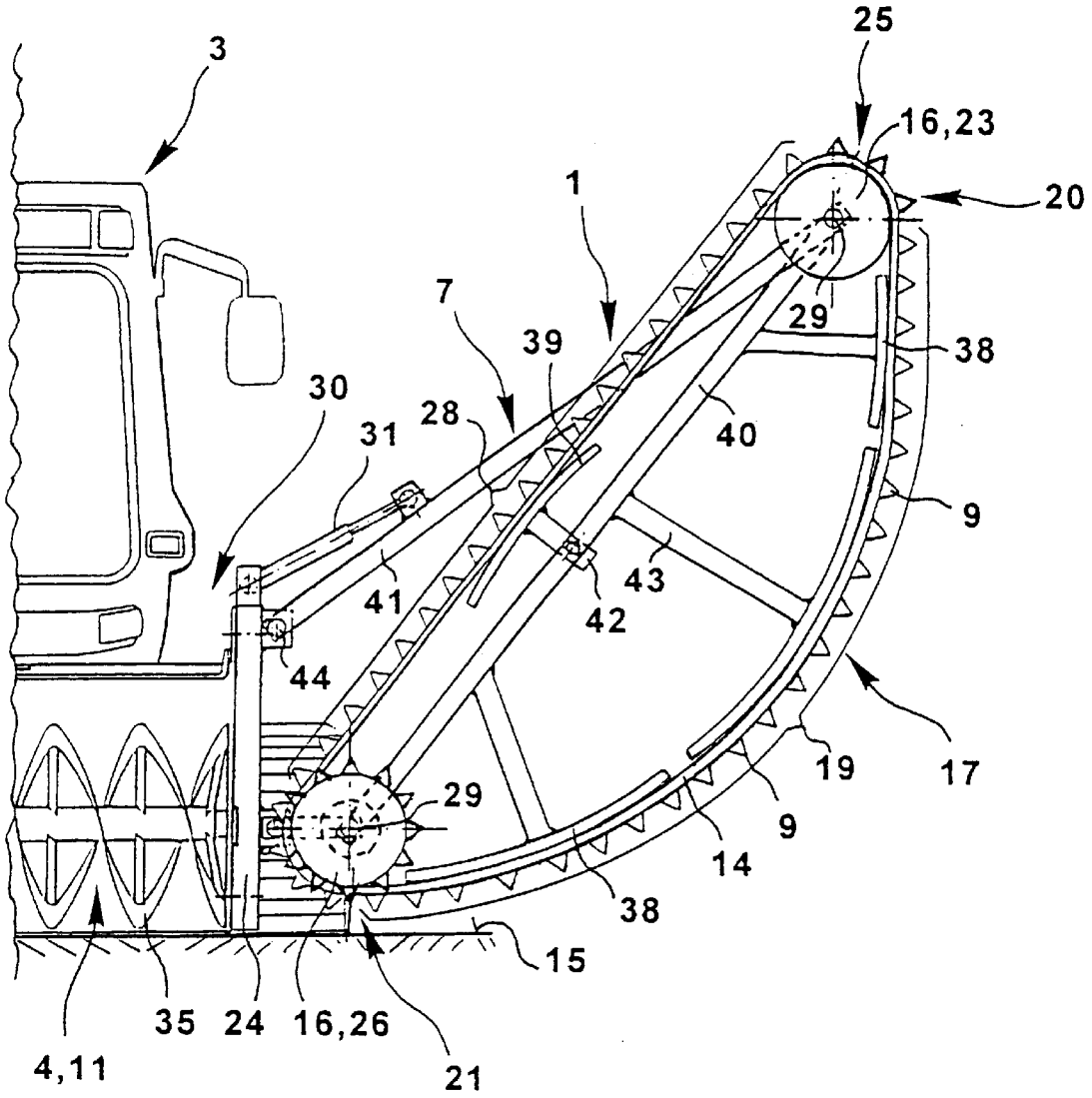

An advantageous embodiment of the invention shall now be explained and described in more detail with reference to the figures attached to the drawing, of which FIG. 1 is a front view of a piste vehicle with a piste-preparation device in a half-pipe;

FIG. 2 is an enlarged front view of the piste-preparation device according to FIG. 1; and FIG. 3 is a further embodiment in accordance with FIG. 2.

FIG. 1 is a front view showing a piste vehicle 3 comprising a piste-preparation device 1 arranged at the front side thereof. The piste-preparation device 1 comprises a rotary snow plow 11 as a tool 4, a blower means 13 and two lateral members 6 and 7 which are laterally arranged relative to the rotary snow plow 11.

The rotary snow plow 11 comprises a shaft 12 which is composed of two sections having oppositely oriented spiral-shaped snow plow means 34 and 35 which are rotatably supported in a corresponding snow plow frame 30. A working width of the shaft 11 corresponds essentially to a flat bottom part of a half-pipe 2. This bottom part is followed at both sides by upwardly curved side walls 5 of the half-pipe. The lateral members 6, 7 rest on a piste surface 15 formed by the side walls 5.

The piste-preparation device 1 is arranged in the direction of travel 8 in front of the piste vehicle 3 and is connected to the vehicle via a corresponding frame (not shown).

A blower means 13 is arranged between piste vehicle 3 and rotary snow plow 11 with an ejection chimney, which is visible in FIG. 1 in front of a front pane of the piste vehicle. The blower means 13 comprises a blower wheel 36 which in the direction of travel 8 is arranged behind the rotary snow plow 11 and is arranged essentially in the center thereof.

FIG. 2 is a front view showing the piste-preparation device 1 of the invention on an enlarged scale and without any coverings or housings. Identical reference numerals mark identical members and are only mentioned in part.

The lateral members 6 and 7 of the piste-preparation device 1 comprise removal means 10 having a number of removal tools 9. Each removal means 10 is formed by an endless chain 14 which the individual removal tools project from essentially in vertical direction. The endless chain 14 is guided over a plurality of wheels or rolls 16. At a piste side 17 of the lateral members 6, 7, the corresponding rolls 16 are designed as contour rolls 18 by which the endless chain 14 is supported in a contour desired for the side walls of the half-pipe; see FIG. 1. These contour rolls 18 define a removal section 19 in which the individual removal tools 19 remove material from the piste surface of the half-pipe. At the ends 20 and 21 of the removal section 19, deflection rolls 22 and 23, respectively, are arranged which in comparison with the contour rolls 18 have a larger diameter. A first deflection roll 22 is arranged next to an end 24 of the rotary snow plow 11 and the shaft 12 of the rotary snow plow, respectively. A second deflection roll 23 is arranged at an end 25 of the lateral member 6 and also of the lateral member 7, the end 25 being opposite to the rotary snow plow 11.

The endless chain 14 is deflected upwards by the first deflection roll 22 essentially in vertical direction. Next to the end 24 of the rotary snow plow 11, the endless chain 14 passes through a lifting section 27 in which the chain is lifted from the piste surface.

A drive roll 26 which is provided with a drive 33 and which in the illustrated embodiment is designed as a spiked roller is arranged at the end of the lifting section 27. The endless chain 14 is guided away from the rotary snow plow 11 by the drive roll 26 and passes through a return section 28 up to the second deflection roll 23. No further rolls are arranged in this section 28 for supporting the endless chain, so that the chain may have a slack in the return section, depending on the respective chain tension.

In the illustrated embodiment, the endless chain 14 moves in the direction of movement 37, i.e. from the second deflection roll 23 to the first deflection roll 22 towards tool 4. Snow is thereby removed from the side walls of the half-pipe, see FIG. 1, towards the rotary snow plow 11.

All of the rolls and wheels, respectively, of the lateral members 6, 7 are supported on these members to rotate about the rotational axes 29, said rotational axes extending in parallel with the direction of travel 8.

The height of the removal tools 9 defines their working depth 32 up to which the removal tools can engage into the piste surface.

To adjust the lateral members, thereby varying the working angle of the members, the lateral members 6, 7 are connected via adjusting cylinders 31 to the frame 30 of the rotary snow plow 11. Depending on the actuation of the adjusting cylinders 31, the ends 25 of the lateral members 6, 7 are arranged above the rotary snow plow 11 at a more or less high level, thereby varying the contour defined by the bottom side of the piste-preparation device 1.

As a rule, the lateral members 6, 7 are arranged in the direction of travel 8 in front of the corresponding tool 4, so that material removed by the removal means 10 from the side walls of the half-pipe can completely be supplied to the tool.

For a simplified illustration, further adjusting means for laterally adjusting the lateral members 6, 7 relative to the tool 4 and for the joint lateral adjustment of the entire piste-preparation device relative to the piste vehicle according to FIG. 1 are not shown.

FIG. 3 shows a further embodiment for a right lateral member 7 according to FIG. 2. Identical members are provided with identical reference numerals and are only mentioned in part.

In contrast to the embodiment of FIG. 2, the endless chain 14 according to FIG. 3 comprises transverse webs or chain webs as removal tools 9, which may detachably be secured to the endless chain. In the area of the removal section 19, the endless chain 14 is guided between a roll 16 which is designed as a drive roll 26 and adjacent to an end 24 of the spiral-shaped snow plow means 25, and a deflection roll 23 over contour slide elements 38. These have a convex curvature in accordance with the contour of the half-pipe side walls.

The endless chain 14 is returned from the deflection roll 23 along an essentially straight path and across a further slide element 38 to the drive roll 26. This slide element as well as the remaining contour slide elements 38 can adjustably and/or pivotably be supported on a corresponding frame of the lateral member 7. In such a case the slide elements 38 are supported via support arms 42, 43 on a carrier 40 extending between the two rotational axes 29 of deflection roll 23 and drive roll 26. This carrier is pivotably supported relative to the rotary snow plow frame 30 at its end assigned to the rotational axis 29 of the drive roll 26. A further carrier 41 extends between an articulation point 44 on the rotary snow plow frame 30 and the rotational axis 29 of the deflection roll 23. The adjusting cylinder 31 is arranged between the carrier 41 and the snow plow frame 30 for adjusting the lateral member 7.

It should be noted that for example one of the contour slide elements can be replaced by corresponding contour wheels/rolls according to FIG. 2.

What is claimed is:

1. A piste -preparation device for preparing a half-pipe, comprising at least one tool which is adjustably mounted on a piste vehicle, and lateral members which are disposed laterally relative to said tool and can essentially be assigned to side walls of the half-pipe, wherein each lateral member comprises a removal means designed with removal tools which are movable substantially transversely to the direction of travel of the piste vehicle for preparing a piste surface of the half-pipe.

2. The piste-preparation device according to claim 1, wherein the tool is a rotary snow plow having at least one shaft and the piste-preparation device further comprises a blower means assigned to the rotary snow plow for displacing snow supplied by the rotary snow plow.

3. The piste-preparation device according to claim 2, wherein the removal tools are movable essentially towards the rotary snow plow for removing snow from the half-pipe side wails.

4. The piste-preparation device according to claim 2, wherein the removal means comprises at least one endless chain which the plurality of removal tools project therefrom towards the piste surface.

5. The piste-preparation device according to claim 4, wherein a plurality of wheels or rolls are rotatably supported on the lateral member for guiding the endless chain.

6. The piste-preparation device according to claim 4, wherein at a piste side of the lateral member which faces the piste surface, the endless chain is guided by a number of contour elements along a convexly curved removal section.

7. The piste-preparation device according to claim 6, wherein the contour elements are designed as contour wheels or rolls or contour slide elements.

8. The piste-preparation device according to claim 6, wherein deflection rolls are arranged at ends of the removal section.

9. The piste-preparation device according to claim 8, wherein a first deflection roll is arranged next to an end of the shaft of the rotary snow plow and a second deflection roll is arranged at the end of the lateral member which is opposite to the rotary snow plow.

10. The piste-preparation device according to claim 9, wherein at least one of the contour rolls or, deflection rolls is designed as a drive roll.

11. The piste-preparation device according to claim 10, wherein the drive roll is designed as a toothed roll.

12. The piste-preparation device according to claim 10, wherein the drive roll is arranged above the first deflection roll, the endless chain between said drive rolls and said first deflector roll passing through a substantially vertical lifting section and passing through a return section between said drive roll and second deflection roll.

13. The piste-preparation device according to claim 8, wherein the rotational axes of all rolls extend essentially in parallel with the direction of travel.

14. The piste-preparation device according to claim 4, wherein the endless chain is guided along the return section without any support.

15. The piste-preparation device according to claim 2, wherein each of the lateral members is adjustably supported at a working angle relative to the shaft of the rotary snow plow.

16. The piste-preparation device according to claim 2, wherein the lateral member is detachably secured to a frame of the rotary snow plow for supporting the shaft of the rotary snow plow and can be adjusted by an adjusting cylinder between the frame of the rotary snow plow and the lateral member at a working angle.

17. The piste-preparation device according to claim 16, wherein said adjustment cylinder and a carrier are arranged between the frame of the rotary snow plow and the lateral member for intermediately supporting and adjusting the lateral member relative to the frame of the rotary snow plow.

18. The piste-preparation device according to claim 4, wherein the endless chain is arranged in the direction of travel in front of the rotary snow plow.

19. The piste-preparation device according to claim 4, wherein the removal tools are transverse webs arranged on the endless chain.

20. The piste-preparation device according to claim 4, wherein the removal tools are scraping elements detachably secured to the endless chain.

21. The piste-preparation device according to claim 1, wherein a working depth of the removal tools decreases in the direction of travel, by first treating said piste surface with removable tools having a smaller working depth and then by removal tools having a larger working depth.

22. The piste-preparation device according to claim 4, wherein the lateral member comprises a smoothing blade arranged downstream of the endless chain in the direction of travel for smoothing the piste surface.

23. The piste-preparation device according to claim 1, wherein the lateral member is extensibly supported in a direction transverse to the direction of travel.

24. The piste-preparation device according to claim 10, wherein each drive roll has assigned thereto a separate, in particular electrical drive.

* * * * *